US007593021B1

(12) United States Patent
Tynefield, Jr. et al.

(10) Patent No.: US 7,593,021 B1
(45) Date of Patent: Sep. 22, 2009

(54) OPTIONAL COLOR SPACE CONVERSION

(75) Inventors: John D. Tynefield, Jr., Los Altos, CA (US); Andrew J. Tao, San Francisco, CA (US); Rui M. Bastos, Porto Alegre (BR); Johnny S. Rhoades, Durham, NC (US)

(73) Assignee: NVIDIA Corp., Santa Clara, CA (US)

( * ) Notice: Subject to any disclaimer, the term of this patent is extended or adjusted under 35 U.S.C. 154(b) by 760 days.

(21) Appl. No.: 10/939,624

(22) Filed: Sep. 13, 2004

(51) Int. Cl.
*G09G 5/02* (2006.01)

(52) U.S. Cl. ..... 345/604

(58) Field of Classification Search ..... 345/604
See application file for complete search history.

(56) References Cited

U.S. PATENT DOCUMENTS 5,856,831 A * 1/1999 Scott et al. ..... 345/503
5,905,504 A * 5/1999 Barkans et al. ..... 345/597
5,926,406 A * 7/1999 Tucker et al. ..... 708/606
6,049,343 A * 4/2000 Abe et al. ..... 345/501
6,486,889 B1 * 11/2002 Meyers et al. ..... 345/604
6,735,334 B2 * 5/2004 Roberts ..... 382/167
6,758,574 B1 * 7/2004 Roberts ..... 362/162
6,954,214 B2 * 10/2005 Wilt et al. ..... 345/591
7,301,543 B2 * 11/2007 Higgins ..... 345/589
2004/0190617 A1 * 9/2004 Shen et al. ..... 375/240.16
2005/0259109 A1 * 11/2005 Stokes ..... 345/590

* cited by examiner

*Primary Examiner*—Ulka Chauhan
*Assistant Examiner*—Daniel Washburn
(74) *Attorney, Agent, or Firm*—Patterson & Sheridan, LLP

(57) ABSTRACT

An apparatus and method for converting color data from one color space to another color space. A driver determines that a set of shader program instructions perform a color conversion function and the set of shader program instructions are replaced with either a single shader program instruction or a flag is set within an existing shader program instruction to specify that output color data is represented in a nonlinear color format. The output color data is converted to the non-linear color format prior to being stored in a frame buffer. Nonlinear color data read from the frame buffer is converted to a linear color format prior to shading, blending, or raster operations.

10 Claims, 8 Drawing Sheets

OPTIONAL COLOR SPACE CONVERSION

FIELD OF THE INVENTION

One or more aspects of the invention generally relate to graphics data processing, and more particularly to converting between color spaces in a programmable graphics processor.

BACKGROUND

Color data generated by current graphics processors output for display is conventionally represented in a nonlinear color format, such as a device independent color format. Additionally color data stored as texture maps is represented in a nonlinear format. A standard device independent color format, such as sRGB, is designed for use with display devices and image capture devices.

Although color data is conventionally represented in a nonlinear format for display, processing of color data is conventionally performed in linear color space. Therefore, processed color data is typically converted to a nonlinear color format prior to output. Performing color conversion using a shader program executed by a graphics processor requires additional computational steps, sometimes resulting in additional passes through a shader pipeline. Therefore, the performance of the graphics processor may degrade when color data is converted from a linear color space to a nonlinear color space.

Accordingly, it is desirable to have a graphics processor that can optionally convert color data represented in one color space to color data represented in another color space prior to storing the color data in a frame buffer without suffering a loss in performance.

SUMMARY

The current invention involves new systems and methods for optionally converting color data from a color space to another color space. A driver may determine that a set of shader program instructions within a shader program perform a color conversion function. The driver may replace the set of shader program instructions with a specific color conversion shader program instruction. Alternatively, the driver may remove the set of shader program instructions and set a flag within a remaining shader program instruction to specify that output color data is represented in a nonlinear color format. The output color data is converted to the nonlinear color format prior to being stored in a frame buffer. Nonlinear color data read from the frame buffer is converted to a linear color format prior to performing shading, blending, or raster operations. Furthermore, each color component may be optionally converted to a linear or nonlinear color format independent of the other color components.

Performing color conversion in hardware specifically designed for color conversion improves the performance of shader programs requiring color conversion. Including detection of color conversion in the driver for a graphics processor permits a shader program written without using a specific color conversion program instruction or without setting a color conversion flag to have improved performance when executed by a graphics processor including color conversion hardware.

Various embodiments of the invention include a system for performing color space conversion. The system includes a shader pipeline, a raster operation unit, and a nonlinear to linear color conversion unit. The shader pipeline is configured to receive fragment data and produce shaded color data. The raster operation unit is configured to received the shaded color data and perform raster operations to produce processed color data. The nonlinear to linear color conversion unit is configured to receive the shaded color data or the processed color data and produce color data represented in a nonlinear color space.

Various embodiments of a method of the invention for performing color space conversion including receiving a first color component, processing the first color component to produce a second color component, and clamping the second color component to produce a third color component. The first color component is represented in a linear color space and includes a sign, an exponent, and a mantissa. The second color component is represented in a nonlinear color space. The second color component is clamped based on the sign and a portion of the exponent of the first color component. The third color component is represented in the nonlinear color space.

Various embodiments of a method of the invention for performing color space conversion using a color space conversion unit within a graphics processor including receiving shader program instructions, determining a portion of the shader program instructions are intended to perform color space conversion, inserting a specific color conversion shader program instruction into the shader program, and executing the specific color conversion shader program instruction to produce converted color data.

BRIEF DESCRIPTION OF THE VARIOUS VIEWS OF THE DRAWINGS

Accompanying drawing(s) show exemplary embodiment (s) in accordance with one or more aspects of the present invention; however, the accompanying drawing(s) should not be taken to limit the present invention to the embodiment(s) shown, but are for explanation and understanding only.

FIG. 1 is a block diagram of an exemplary embodiment of a respective computer system in accordance with one or more aspects of the present invention including a host computer and a graphics subsystem.

FIGS. 2A, 2B, and 2C are block diagrams of exemplary embodiments of the programmable graphics processing pipeline and raster operation unit of FIG. 1 in accordance with one or more aspects of the present invention.

DISCLOSURE OF THE INVENTION

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
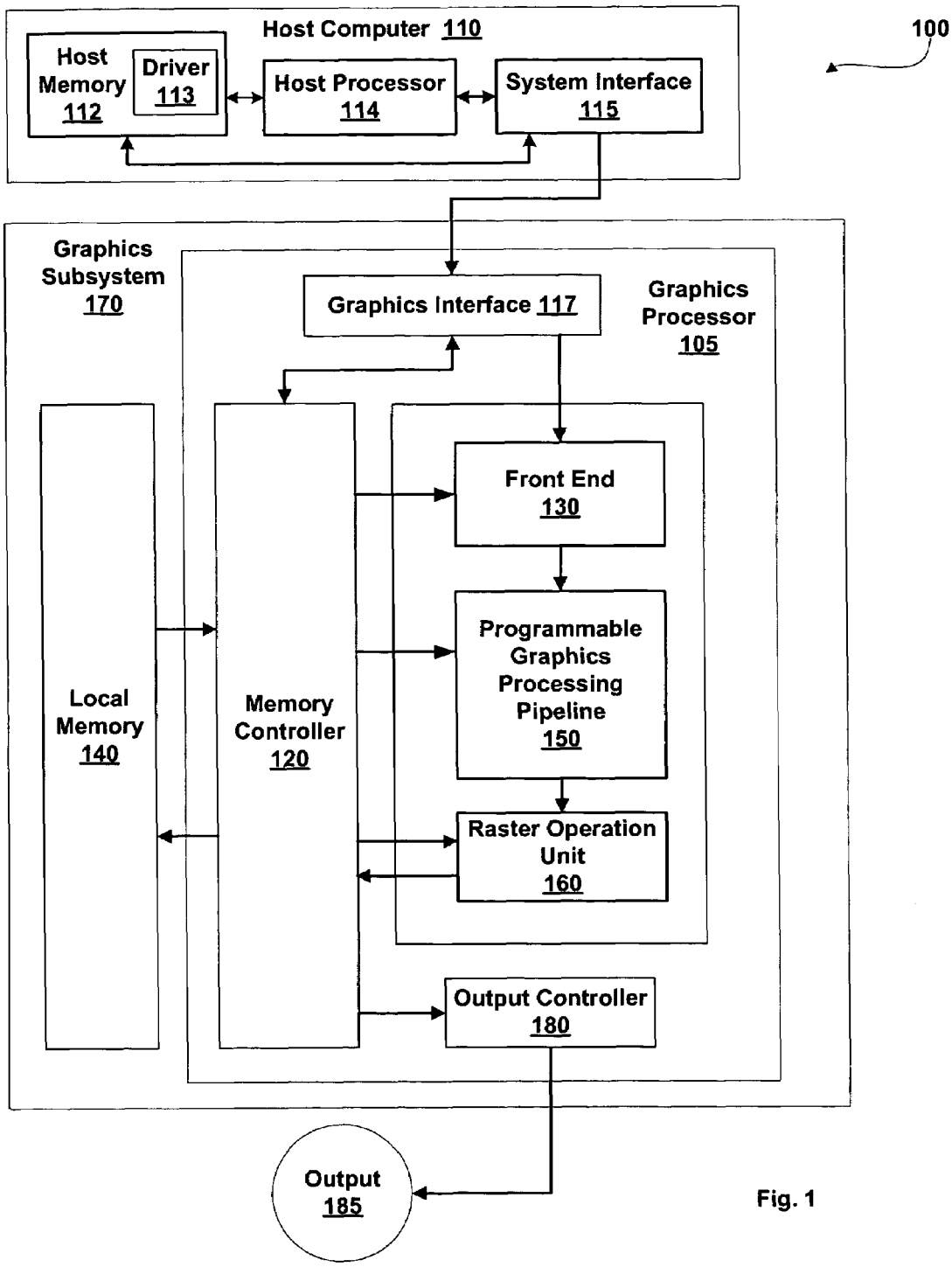

FIG. 1 is an illustration of a Computing System generally designated 100 and including a Host Computer 110 and a Graphics Subsystem 170. Computing System 100 may be a desktop computer, server, laptop computer, palm-sized computer, tablet computer, game console, portable wireless terminal such as a personal digital assistant (PDA) or cellular telephone, computer based simulator, or the like. Host Computer 110 includes a Host Processor 114 that may include a system memory controller to interface directly to a Host Memory 112 or may communicate with Host Memory 112 through a System Interface 115. System Interface 115 may be an I/O (input/output) interface or a bridge device including the system memory controller to interface directly to Host Memory 112. An example of System Interface 115 known in the art includes Intel® Northbridge.

Host Computer 110 communicates with Graphics Subsystem 170 via System Interface 115 and a Graphics Interface 117 within a Graphics Processor 105. Data received at Graphics Interface 117 can be passed to a Front End 130 or written to a Local Memory 140 through Memory Controller 120. Graphics Processor 105 uses graphics memory to store graphics data and program instructions, where graphics data is any data that is input to or output from components within the graphics processor. Graphics memory may include portions of Host Memory 112, Local Memory 140, register files coupled to the components within Graphics Processor 105, and the like.

A Graphics Processing Pipeline 125 within Graphics Processor 105 includes, among other components, Front End 130 that receives commands from Host Computer 110 via Graphics Interface 117. Front End 130 interprets and formats the commands and outputs the formatted commands and data to a Shader Pipeline 150. Some of the formatted commands are used by Shader Pipeline 150 to initiate processing of data by providing the location of program instructions or graphics data stored in memory. Front End 130, Shader Pipeline 150, and a Raster Operation Unit 160 each include an interface to Memory Controller 120 through which program instructions and data can be read from memory, e.g., any combination of Local Memory 140 and Host Memory 112. When a portion of Host Memory 112 is used to store program instructions and data, the portion of Host Memory 112 can be uncached so as to increase performance of access by Graphics Processor 105.

Front End 130 optionally reads processed data, e.g., data written by Raster Operation Unit 160, or data written by Host Processor 112, from memory and outputs the data, processed data and formatted commands to Shader Pipeline 150. Shader Pipeline 150 and Raster Operation Unit 160 each contain one or more programmable processing units to perform a variety of specialized functions. Some of these functions are table lookup, scalar and vector addition, multiplication, division, coordinate-system mapping, calculation of vector normals, tessellation, calculation of derivatives, interpolation, and the like. Shader Pipeline 150 and Raster Operation Unit 160 are each optionally configured such that data processing operations are performed in multiple passes through those units or in multiple passes within Shader Pipeline 150. Raster Operation Unit 160 includes a write interface to Memory Controller 120 through which data can be written to memory, such as Local Memory 140 or Host Memory 112.

In a typical implementation Shader Pipeline 150 performs geometry computations, rasterization, and fragment computations. Therefore, Shader Pipeline 150 is programmed to operate on surface, primitive, vertex, fragment, pixel, sample or any other data. Programmable processing units within Shader Pipeline 150 may be programmed to perform specific operations, including color space conversion, using a shader program. Shader Pipeline 150 may also be configured to perform color space conversion using a unit optimized for color space conversion by using a state bundle to set a mode or a specific color space conversion shader program instruction. State bundles may be used outside of shader programs to set specific modes or state which is typically used for several shader programs. Specifically, a driver 113 may determine that a set of shader program instructions within a shader program perform a color conversion function. Driver 113 may replace the set of shader program instructions with a specific color conversion shader program instruction. Alternatively, driver 113 may remove the set of shader program instructions and set a flag within a remaining shader program instruction to specify that output color data is represented in a nonlinear color format.

Shaded fragment data output by Shader Pipeline 150 are passed to a Raster Operation Unit 160, which optionally performs near and far plane clipping and raster operations, such as stencil, z test, and the like, and saves the results or the samples output by Shader Pipeline 150 in Local Memory 140. When the data received by Graphics Subsystem 170 has been completely processed by Graphics Processor 105, an Output 185 of Graphics Subsystem 170 is provided using an Output Controller 180. Output Controller 180 is optionally configured to deliver data to a display device, network, electronic control system, other computing system such as Computing System 100, other Graphics Subsystem 170, or the like. Alternatively, data is output to a film recording device or written to a peripheral device, e.g., disk drive, tape, compact disk, or the like.

Figure 2A:
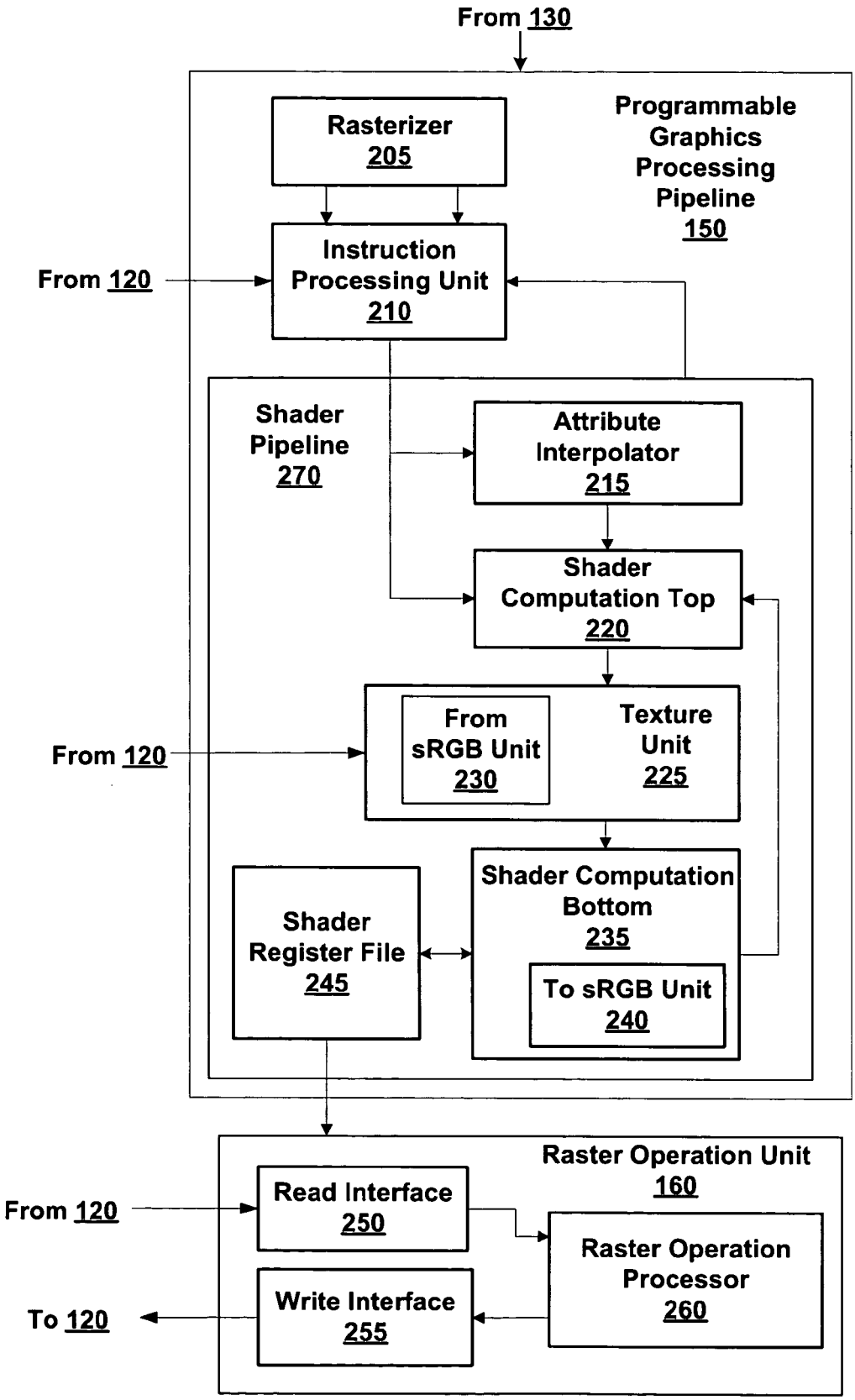

FIG. 2A is a block diagram of an exemplary embodiment of Programmable Graphics Processing Pipeline 150 and Raster Operation Unit 160 of FIG. 1, in accordance with one or more aspects of the present invention. Surfaces may be processed to produce primitives, the primitives may be processed to produce vertices, and the vertices may be processed by a Rasterizer 205 to produce fragments. An Instruction Processing Unit 210 within Programmable Graphics Processing Pipeline 150 receives a raster stream and a program stream from Rasterizer 130. The raster stream includes pixel packets of pixel data and register load packets of state bundles.

Some state bundles are converted into shader program instructions within Instruction Processing Unit 210. For example, a state bundle enabling color format conversion from RGB to sRGB or from sRGB to RGB may be replaced by a specific color space conversion shader program instruction. In an alternate embodiment of the present invention, a flag specifying that color conversion should be performed is inserted into an existing shader program instruction, for example, the last instruction in a shader program may include the flag specifying that processed output color be converted, if needed, to sRGB format. Furthermore, color space conversion may be enabled for a single color component, or for two or more color components. Specifically, color conversion to a nonlinear color space may be specified for R, G, and B, but not for alpha. Likewise, color conversion from a nonlinear color space may be specified for R, G, and B, but not for alpha. A specific color conversion shader program instruction, any shader program instruction including a flag, or a state bundle may specify conversion of one or more color components.

The program stream received by Instruction Processing Unit 210 from Rasterizer 205 includes shader program instructions. Instruction Processing Unit 210 also reads other program instructions from graphics memory via Memory Controller 120. In some embodiments of the present invention, Instruction Processing Unit 210 includes an instruction cache and program instructions which are not available in the instruction cache, for example when a branch instruction is executed, are read from graphics memory.

Instruction Processing Unit 210 outputs shader program instructions and pixel packets to an Attribute Interpolator 215 within Shader Pipeline 270. Attribute Interpolator 215 processes the pixel packets as specified by the shader program instructions and any state bundles that are not translated into shader program instructions. For example, Attribute Interpolator 215 may perform clipping and produce interpolated attributes, including texture coordinates, barycentric coefficients, and depth values. The barycentric coefficients may be used for computing interpolated primary and secondary colors, and interpolated fog distance. Attribute Interpolator 215 outputs the interpolated attributes to a Shader Computation Top 220.

Shader Computation Top 220 also receives shader program instructions and state bundles that are not translated into shader program instructions from Instruction Processing Unit 210. Shader Computation Top 220 performs perspective correction of the interpolated attributes (input operands). Shader Computation Top 272 may also receive input operands from a Shader Register File 245 via a Shader Computation Bottom 235. Shader Computation Top 220 may be programmed to clamp input operands and scale perspective corrected attributes. Shader Computation Top 220 outputs the perspective corrected attributes to a Texture Unit 225. Shader Computation Top 220 also outputs input operands that are received from Shader Register File 245 for Texture Unit 225.

Texture Unit 225 receives the perspective corrected attributes and any input operands and performs texture lookups to read texels stored in graphics memory. Texture Unit 225 remaps texels to a format that may be stored in Shader Register File 245, for example, a 16-bit or 32-bit floating point value. Texture Unit 225 may be programmed to clamp the texels and perform color space conversion using a From sRGB Unit 230. From sRGB Unit 230 converts one or more color components represented in sRGB color space to one or more color components represented in RGB color space. Texture Unit 225 may also pass perspective corrected attributes through from Shader Computation Top 220 to Shader Computation Bottom 235.

Shader Computation Bottom 235 may be configured by shader program instructions to perform fragment shading operations, receiving color data and texels and producing shaded fragment data. Shader Computation Bottom 235 includes multiply-accumulate units and a computation unit capable of executing scalar instructions such as $\log_2$, sine, cosine, and the like. Shader Computation Bottom 235 may read source data stored in Shader Register File 245. The shaded fragment data and/or the source data may be output by Shader Computation Bottom 235 to Shader Computation Top 220.

Shader Computation Bottom 235 may also write destination data, e.g., shaded fragment data, into output registers within Shader Register File 245 which are output to Raster Operation Unit 160. A To sRGB Unit 240 within Shader Computation Bottom 235 may be configured to convert one or more color components of the shaded fragment data from RGB format to sRGB format prior to outputting the shaded fragment data to Shader Register File 245.

A conventional shader pipeline, without dedicated hardware to perform color space conversion, such as To sRGB Unit 240 and From sRGB Unit 230, may be configured to perform color space conversion using existing programmable processing units executing shader program instructions. Performing linear to nonlinear color space conversion using shader program instructions may require as many as four additional passes through Shader Computation Top 220, Texture Unit 225, and Shader Computation Bottom 235 to complete the color space conversion, resulting in a significant performance impact. In contrast, when To sRGB Unit 240 is used to perform color space conversion, no additional passes are needed. The additional hardware needed to perform the color space conversion may be combined with floating point to fixed point format conversion hardware, as described in conjunction with FIG. 3.

Shaded fragment data stored in Shader Register File 245 is output to Raster Operation Unit 160 along with state bundles which are used to configure fixed function units within Raster Operation Unit 160. Raster Operation Unit 160 includes a Read Interface 250, a Raster Operation Processor 260, and a Write Interface 255. Read Interface 250 reads fragment data stored in a frame buffer, e.g., frame buffer data, in graphics memory via Memory Controller 120. The frame buffer data is read from the location specified by the fragment data received from Shader Pipeline 270. The frame buffer data may include color data represented in a linear or nonlinear color format. Raster Operation Processor 260 receives the frame buffer data and the shaded fragment data and performs raster operations as specified by the state bundles. Raster Operation Processor 260 optionally writes the shaded fragment data to graphics memory based on the results of the raster operations via Write Interface 255.

When blending is used to combine the shaded fragment data with the frame buffer data to produce blended fragment data, the shaded fragment data and the frame buffer data should be represented in a linear color space. In some embodiments of the present invention, a To sRGB Unit 240 may be included in Raster Operation Unit 160 to convert the blended fragment color data from linear color space to nonlinear color space.

Figure 2B:
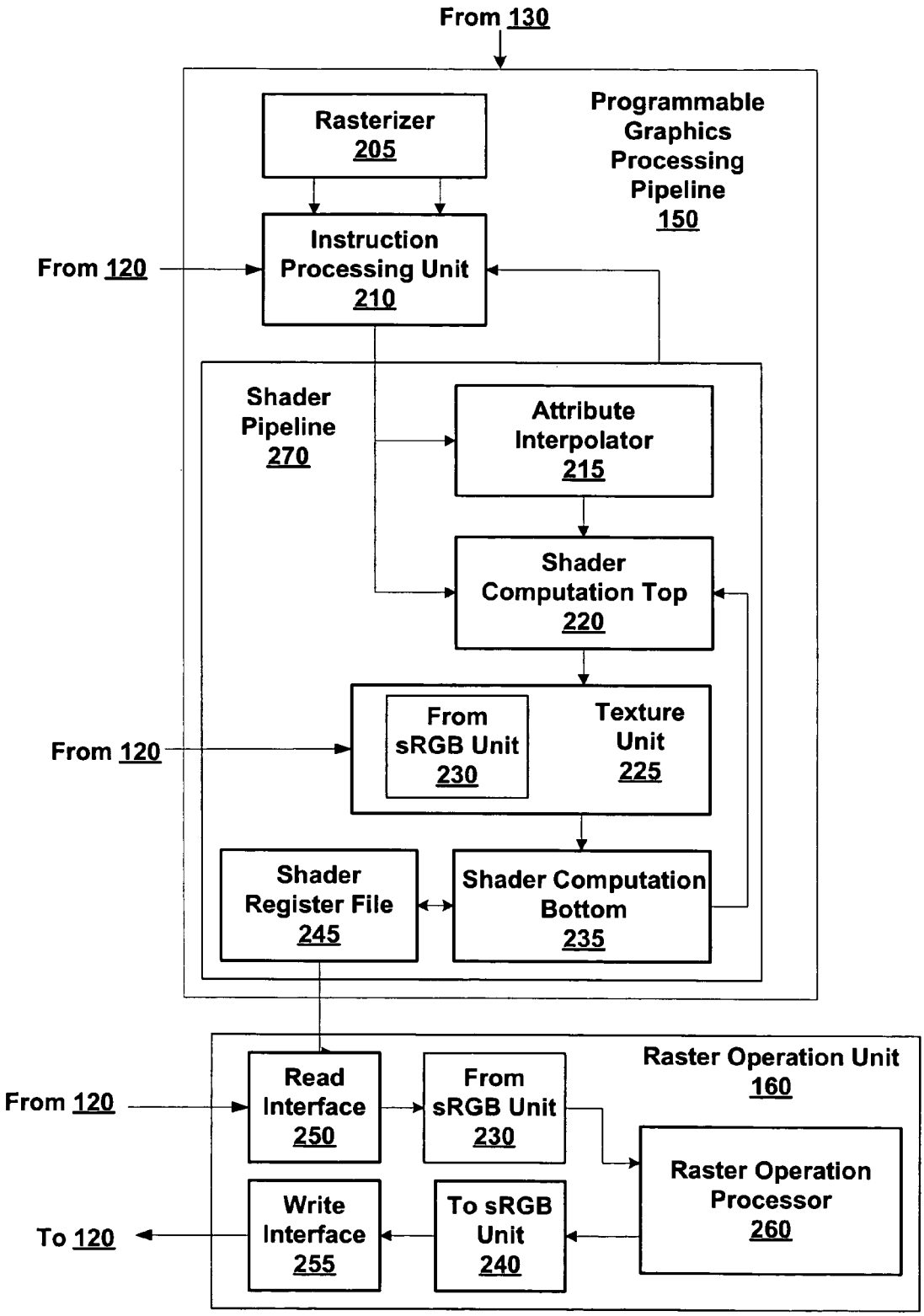

FIG. 2B is a block diagram of another exemplary embodiment of Programmable Graphics Processing Pipeline 150 and Raster Operation Unit 160 of FIG. 1, in accordance with one or more aspects of the present invention. In this embodiment of the present invention, To sRGB Unit 240 is included in Raster Operation Unit 160 to convert blended fragment color data or shaded fragment color data from linear color space into nonlinear color space. To sRGB Unit 240 is omitted from Shader Computation Bottom 235, therefore Shader Register File 245 outputs shaded fragment data that is represented in a linear color space. Furthermore, a From sRGB Unit 230 is included in Raster Operation Unit 160 to optionally convert fragment color data read from graphics memory from nonlinear color space to linear color space for use in performing raster operations. Persons skilled in the art will appreciate that any system configured to perform color conversion of shaded fragment color data and/or of color fragment data used for raster operations, is within the scope of the present invention.

Figure 2C:
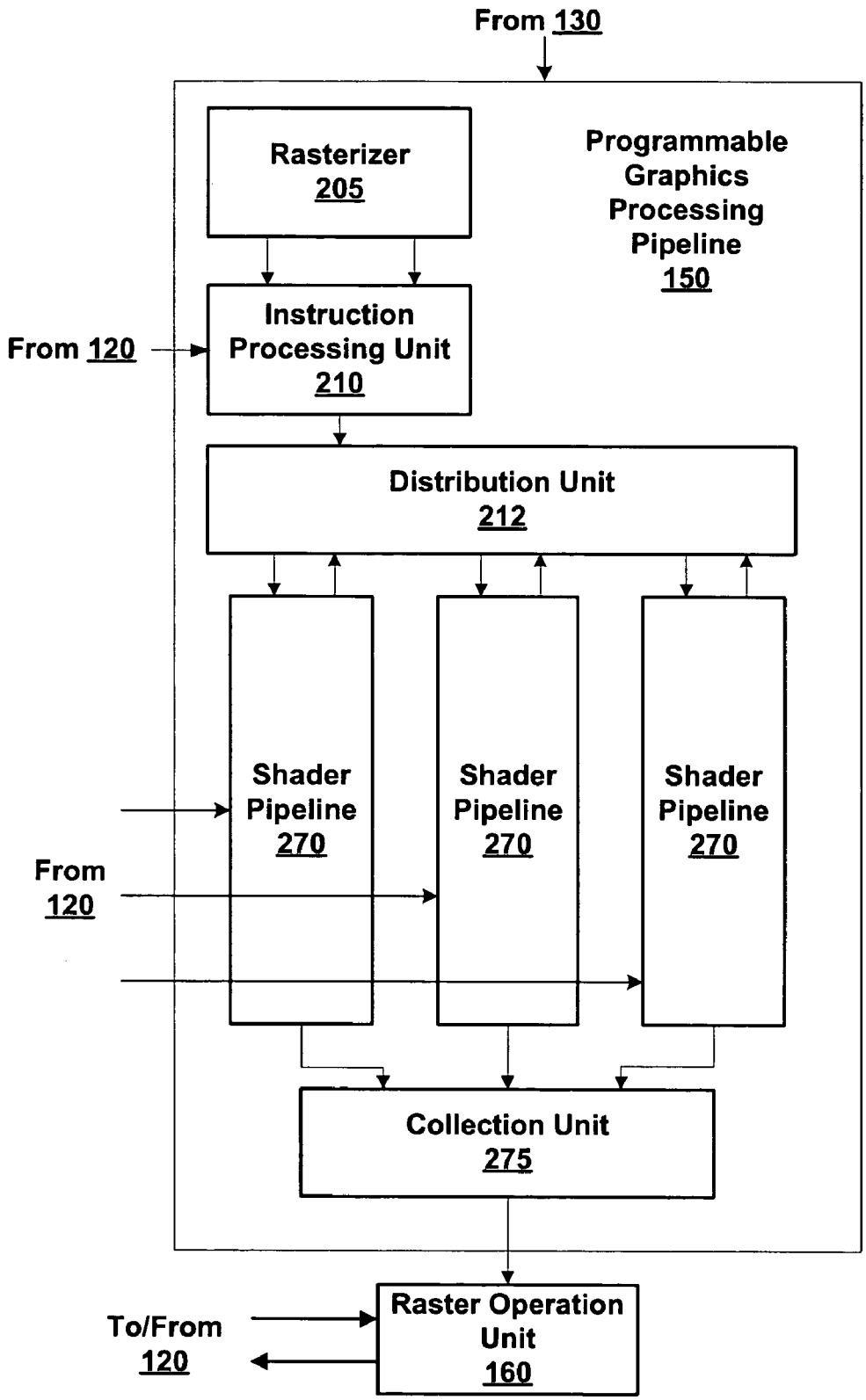

FIG. 2C is a block diagram of another exemplary embodiment of a portion of Programmable Graphics Processing Pipeline 150 and Raster Operation Unit 160 of FIG. 1, in accordance with one or more aspects of the present invention. Programmable Graphics Processing Pipeline 150 includes three Shader Pipelines 270. In alternate embodiments of Programmable Graphics Processing Pipeline 150, fewer or more Shader Pipelines 270 are included. A Distribution Unit 212 receives the raster stream and shader program instructions from Instruction Processing Unit 210 and distributes the shader program instructions to one or more Shader Pipelines 270. Distribution Unit 212 distributes each pixel packet from the raster stream to one Shader Pipeline 270 for processing. A Collection Unit 275 gathers the shaded fragment data from each Shader Pipeline 270 and outputs the shaded fragment data to Raster Operation Unit 160. Shader Pipelines 270 and Raster Operation Unit 160 may each include a From sRGB Unit 230 and a To sRGB Unit 240.

Figure 3:
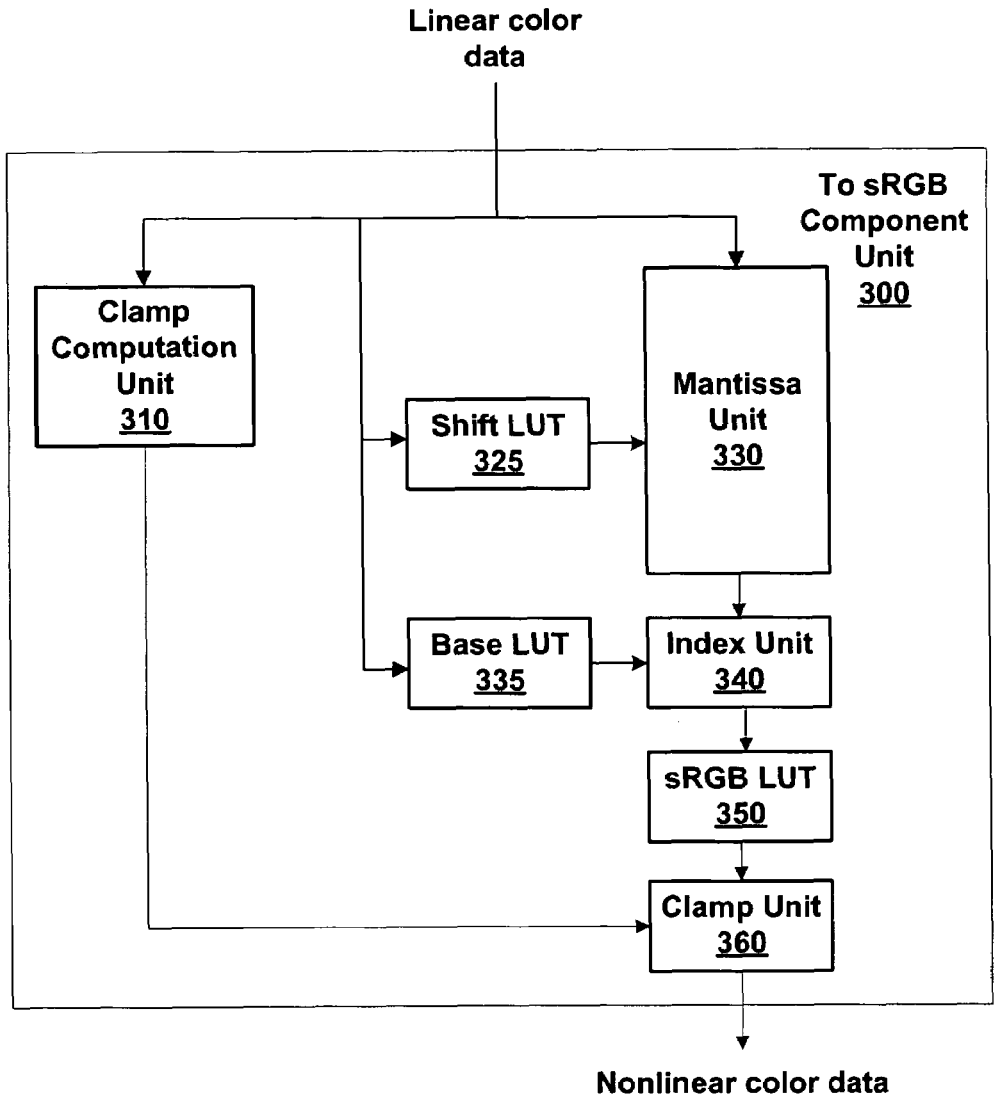
FIG. 3 is a block diagram of a color component conversion unit in accordance with one or more aspects of the present invention.

FIG. 3 is a block diagram of To sRGB Component Unit 300 in accordance with one or more aspects of the present invention. One or more To sRGB Component Units 300 may be included within To sRGB Unit 240. Each To sRGB Component Unit 300 converts a component, e.g., R, G, B, or alpha, of color data represented in linear color space in a 32 or 16 bit floating point format to a component of color data represented in nonlinear color space. In some embodiments of the present invention, To sRGB Unit 240 includes a To sRGB Component Unit 300 for each of R, G, and B, but not for alpha.

To sRGB Component Unit 300 processes the color data represented in linear color space to produce color data represented in nonlinear space that is represented in a fixed point format, such as an 8-bit integer, 10-bit integer, or the like. The sign bit and most significant exponent bit are processed by a Clamp Computation Unit 310 to produce a clamp selection. When the sign is negative, the clamp selection selects 0x0 for output by a Clamp Unit 360. When the most significant exponent bit is asserted, the clamp selection selects 0xff, e.g., 1.0, for output by Clamp Unit 360. When the sign is positive or the most significant exponent bit is negated, the clamp selection selects the output of a sRGB LUT 350 for output by Clamp Unit 360.

To sRGB Component Unit 300 receives an exponent of the color data represented in linear color space without the msb (most significant bit), i.e., the low exponent bits. In some embodiments of the present invention, when a 16-bit floating point format is used, To sRGB Component Unit 300 receives 4 bits of exponent. The low exponent bits are input to a Shift LUT (look up table) 325 and a Base LUT 335. Each LUT may be implemented as a read only memory (ROM), register file, or the like. In other embodiments of the present invention, the function performed by each LUT or any combination of the Shift LUT 325 and Base LUT 335 is performed by computation units such as adders, multipliers, multiplexers, and the like. Shift LUT 325 outputs a shift value that is used by a Mantissa Unit 330 to shift a mantissa of the color data represented in linear color space, effectively dividing the mantissa by $2^{shift\ value}$, to produce a shifted mantissa. In some embodiments of the present invention, the shift value is a 4-bit integer and the mantissa is a 10-bit value with an implied leading one.

Base LUT 335 receives the low exponent bits and outputs a base value that is received by an Index Unit 340 and summed with the shifted mantissa to produce an index. In some embodiments of the present invention, a rounding factor is also summed with the shifted mantissa and base value to produce the index. For example, the rounding factor may be based on the mantissa of the color value divided by $2^{shift\ value-1}$. In other embodiments of the present invention, the shifted mantissa is truncated prior to summing it with the base value.

The index is output by Index Unit 340 to sRGB LUT 350. In some embodiments of the present invention sRGB LUT 350 includes 388 entries, each entry read using the index. In other embodiments of the present invention, the function performed by sRGB LUT 350 is performed by computation units such as adders, multipliers, multiplexers, and the like. sRGB LUT 350 outputs a fixed point value, such as an 8-bit integer or a 10-bit integer that is clamped by Clamp Unit 360. Clamp Unit 360 outputs the color data represented in nonlinear color space, specifically 0x0, 0xff, or the output of sRGB LUT 350, based on the clamp selection received from Clamp Computation Unit 310. In some embodiments of the present invention the color data represented in nonlinear color space, such as a component of a sRGB color is represented as an 8-bit integer, a 10-bit integer, or the like.

Figure 4:
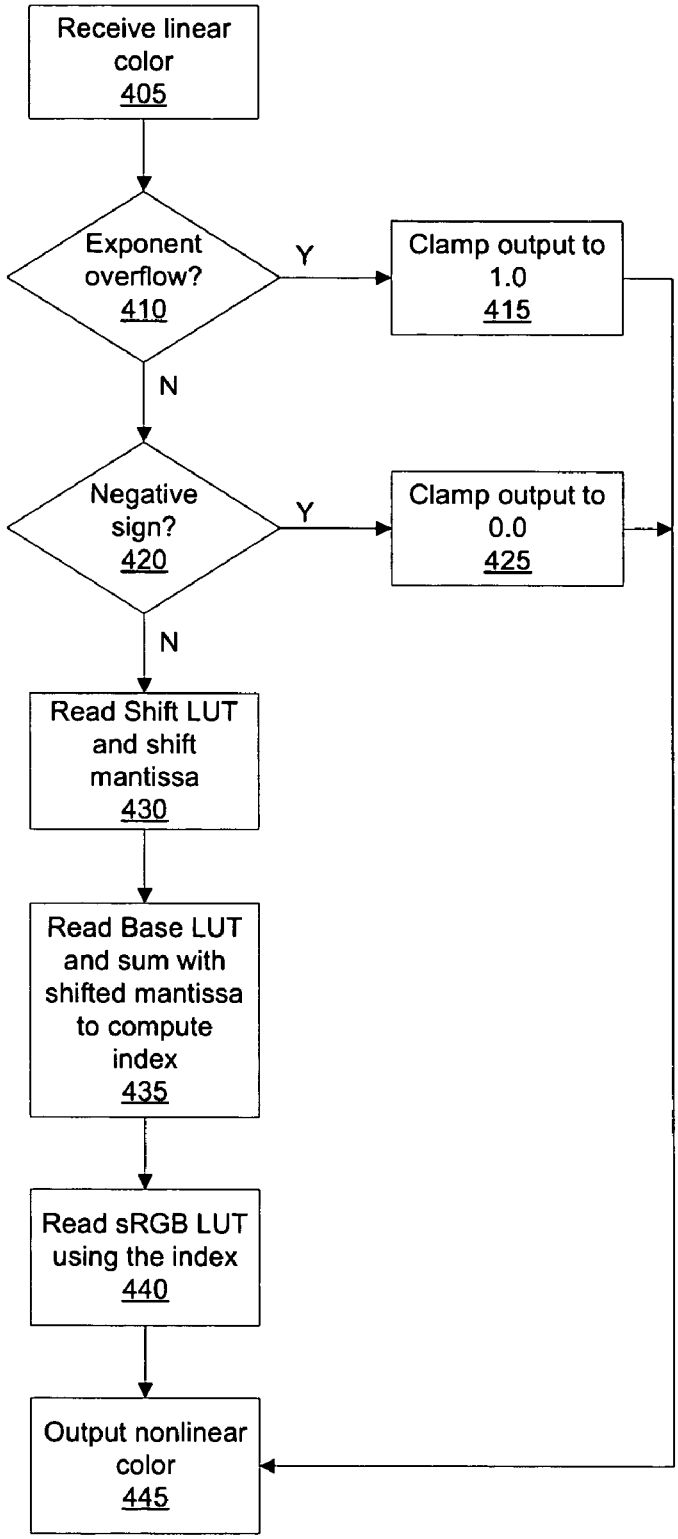
FIG. 4 is an exemplary embodiment of a method of color space conversion in accordance with one or more aspects of the present invention.

FIG. 4 is an exemplary embodiment of a method of color space conversion in accordance with one or more aspects of the present invention. In step 405 To sRGB Component Unit 300 receives linear color space data. The linear color space data may be represented in a floating point format, including any number of bits, e.g., 16 bits, 24 bits, or 32 bits. In step 410 Clamp Computation Unit 310 determines if the exponent of the linear color space data is overflowed, i.e., if the msb is asserted. If, in step 410 Clamp Computation Unit 310 determines the exponent is overflowed, then in step 415 Clamp Unit 360 selects a value of 1.0 for output as the color data represented in nonlinear color space. In step 445 Clamp Unit 360 outputs the color data represented in nonlinear color space.

If, in step 410 Clamp Computation Unit 310 determines the exponent is not overflowed, then in step 420 Clamp Computation Unit 310 determines if the sign of the linear color space data is negative, and, if so, in step 425 Clamp Unit 360 selects a value of 0 for output as the color data represented in nonlinear color space. If, in step 420 Clamp Computation Unit 310 determines the sign of the linear color space data is not negative, i.e. the sign of the linear color space data is positive, then, in step 430 Shift LUT 325 receives a portion of the exponent, such as the lowest 4 bits of a 5 bit exponent, to read a shift value. In step 430 Mantissa Unit 330 shifts the mantissa of the linear color space data by the shift value, effectively dividing the mantissa by $2^{shift\ value}$ to produce a shifted mantissa. In some embodiments of the present invention the contents of each entry within Shift LUT 325 are represented by the follow array:

{10, 10, 10, 10, 9, 8, 7, 6, 6, 6, 5, 5, 4, 4, 3, 10}, where a 0x0 input corresponds to the first value in the array and a 0xf input corresponds to the last value in the array. In other embodiments of the present invention, Shift LUT 325 includes fewer or more entries and may include a different value for each entry.

In step 435, Exponent Unit 320 outputs the portion of the exponent to Base LUT 335 to read a base value. In step 435, Index Unit 340 sums the base value with the shifted mantissa to compute an index. In some embodiments of the present invention the contents of each entry within Base LUT 335 are represented by the follow array:

{0, 1, 2, 3, 4, 6, 10, 18, 34, 50, 66, 98, 130, 194, 258, 386}, where a 0x0 input corresponds to the first value in the array and a 0xf input corresponds to the last value in the array. In other embodiments of the present invention, Base LUT 335 includes fewer or more entries and may include a different value for each entry.

In step 440 the index is output by Index Unit 340 to read sRGB LUT 350. sRGB LUT 350 outputs a fixed point value to Clamp Unit 360 and Clamp Unit 360 selects the fixed point value for output as the color data represented in nonlinear color space. In some embodiments of the present invention the contents of each entry within sRGB LUT 350 are represented by the follow array:

{0x00, 0x00, 0x00, 0x01, 0x02, 0x02, 0x03, 0x04, 0x05, 0x06, 0x06, 0x07, 0x08, 0x09, 0x0a, 0x0a, 0x0b, 0x0c, 0x0d, 0x0d, 0x0e, 0x0f, 0x0f, 0x10, 0x10, 0x11, 0x12, 0x12, 0x13, 0x13, 0x14, 0x14, 0x15, 0x15, 0x16, 0x17, 0x17, 0x18, 0x19, 0x1a, 0x1b, 0x1b, 0x1c, 0x1d, 0x1e, 0x1e, 0x1f, 0x20, 0x20, 0x21, 0x22, 0x23, 0x24, 0x25, 0x26, 0x27, 0x28, 0x29, 0x2a, 0x2b, 0x2c, 0x2d, 0x2e, 0x2f, 0x30, 0x31, 0x31, 0x32, 0x33, 0x34, 0x35, 0x35, 0x36, 0x37, 0x38, 0x38, 0x39, 0x3a, 0x3a,

0x3b, 0x3c, 0x3c, 0x3d, 0x3e, 0x3e, 0x3f, 0x40, 0x40, 0x41, 0x42, 0x42, 0x43, 0x43, 0x44, 0x44, 0x45, 0x46, 0x46, 0x47, 0x48, 0x49, 0x4a, 0x4b, 0x4c, 0x4d, 0x4e, 0x4f, 0x50, 0x51, 0x52, 0x53, 0x54, 0x55, 0x55, 0x56, 0x57, 0x58, 0x59, 0x5a, 0x5b, 0x5b, 0x5c, 0x5d, 0x5e, 0x5f, 0x5f, 0x60, 0x61, 0x62, 0x62, 0x63, 0x64, 0x65, 0x65, 0x66, 0x67, 0x67, 0x68, 0x69, 0x69, 0x6a, 0x6b, 0x6b, 0x6c, 0x6d, 0x6d, 0x6e, 0x6f, 0x6f, 0x70, 0x71, 0x71, 0x72, 0x73, 0x73, 0x74, 0x74, 0x75, 0x76, 0x76, 0x77, 0x77, 0x78, 0x78, 0x79, 0x7a, 0x7a, 0x7b, 0x7b, 0x7c, 0x7c, 0x7d, 0x7e, 0x7e, 0x7f, 0x7f, 0x80, 0x80, 0x81, 0x81, 0x82, 0x82, 0x83, 0x83, 0x84, 0x84, 0x85, 0x85, 0x86, 0x86, 0x87, 0x87, 0x88, 0x88, 0x89, 0x8a, 0x8b, 0x8c, 0x8d, 0x8e, 0x8f, 0x90, 0x91, 0x91, 0x92, 0x93, 0x94, 0x95, 0x96, 0x97, 0x98, 0x99, 0x99, 0x9a, 0x9b, 0x9c, 0x9d, 0x9e, 0x9e, 0x9f, 0xa0, 0xa1, 0xa2, 0xa2, 0xa3, 0xa4, 0xa5, 0xa6, 0xa6, 0xa7, 0xa8, 0xa9, 0xa9, 0xaa, 0xab, 0xac, 0xac, 0xad, 0xae, 0xae, 0xaf, 0xb0, 0xb1, 0xb1, 0xb2, 0xb3, 0xb3, 0xb4, 0xb5, 0xb5, 0xb6, 0xb7, 0xb8, 0xb8, 0xb9, 0xba, 0xba, 0xbb, 0xbc, 0xbc, 0xbd, 0xbd, 0xbe, 0xbf, 0xbf, 0xc0, 0xc1, 0xc1, 0xc2, 0xc3, 0xc3, 0xc4, 0xc4, 0xc5, 0xc6, 0xc6, 0xc7, 0xc7, 0xc8, 0xc9, 0xc9, 0xca, 0xca, 0xcb, 0xcc, 0xcc, 0xcd, 0xcd, 0xce, 0xcf, 0xcf, 0xd0, 0xd0, 0xd1, 0xd1, 0xd2, 0xd3, 0xd3, 0xd4, 0xd4, 0xd5, 0xd5, 0xd6, 0xd6, 0xd7, 0xd8, 0xd8, 0xd9, 0xd9, 0xda, 0xda, 0xdb, 0xdb, 0xdc, 0xdc, 0xdd, 0xdd, 0xde, 0xdf, 0xdf, 0xe0, 0xe0, 0xe1, 0xe1, 0xe2, 0xe2, 0xe3, 0xe3, 0xe4, 0xe4, 0xe5, 0xe5, 0xe6, 0xe6, 0xe7, 0xe7, 0xe8, 0xe8, 0xe9, 0xe9, 0xea, 0xea, 0xeb, 0xeb, 0xec, 0xec, 0xed, 0xed, 0xee, 0xee, 0xef, 0xef, 0xef, 0xf0, 0xf0, 0xf1, 0xf1, 0xf2, 0xf2, 0xf3, 0xf3, 0xf4, 0xf4, 0xf5, 0xf5, 0xf6, 0xf6, 0xf6, 0xf7, 0xf7, 0xf8, 0xf8, 0xf9, 0xf9, 0xfa, 0xfa, 0xfb, 0xfb, 0xfb, 0xfc, 0xfc, 0xfd, 0xfd, 0xfe, 0xfe, 0xff, 0xff, 0xff}, where a 0x0 input corresponds to the first value in the array and a 0x183 (decimal 387) input corresponds to the last value in the array. In other embodiments of the present invention, sRGB LUT 350 includes fewer or more entries and may include a different value for each entry. In step 445 Clamp Unit outputs the color data represented in nonlinear color space selected in step 415, 425, or 445. The color space conversion may be optionally applied to one or more of the color components. Furthermore, the color space conversion is performed using some of the operations used to perform floating point to fixed point conversion and some units within To sRGB Unit 240 are used for both purposes. Therefore, the incremental cost of supporting color space conversion in hardware is lower. Shader program performance may be improved by using hardware specifically designed for color conversion, such as To sRGB Unit 240 or From sRGB Unit 230, to perform color conversion.

Figure 5:
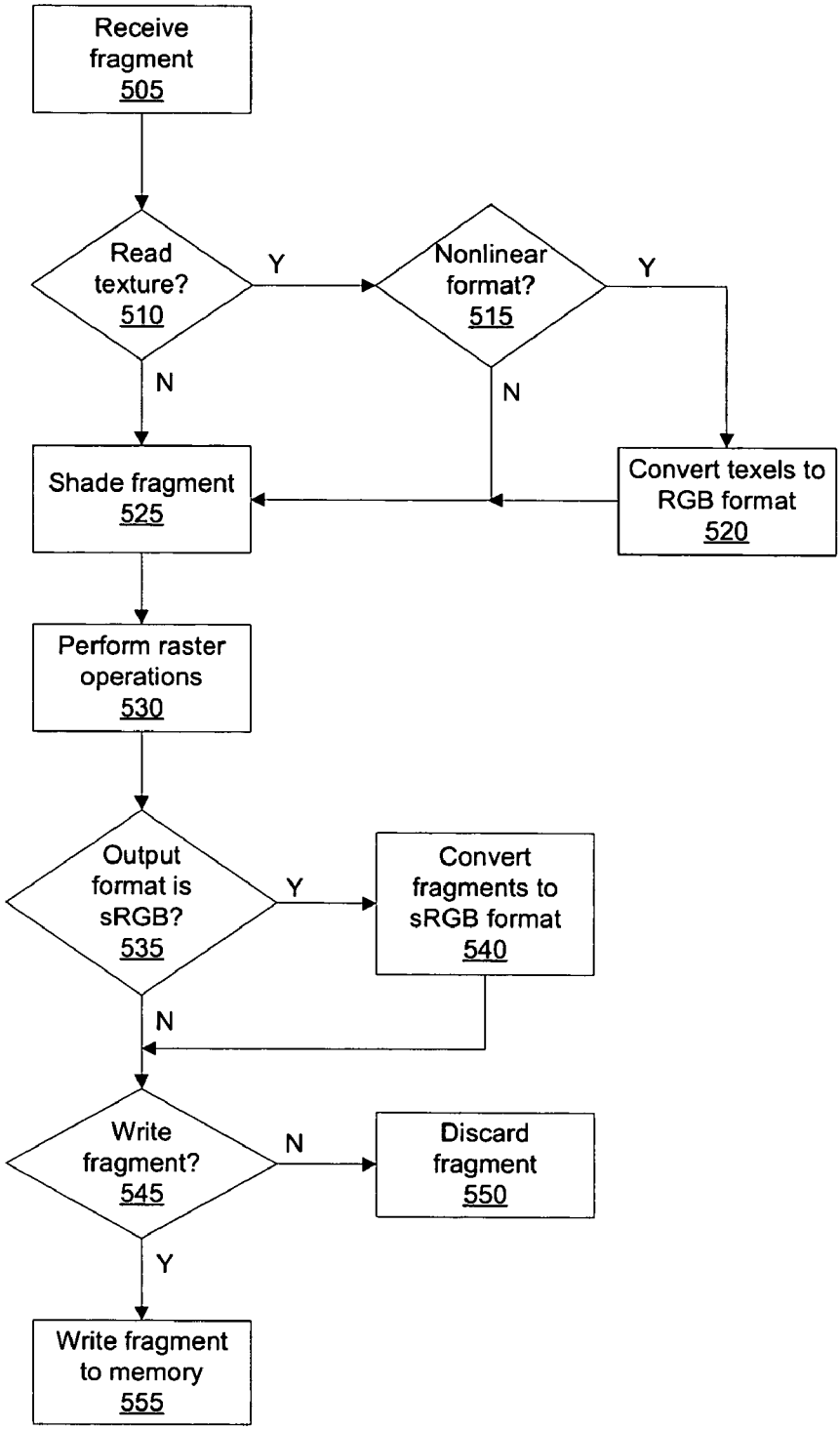
FIG. 5 is an exemplary embodiment of a method of executing a shader program including color space conversion in accordance with one or more aspects of the present invention.

FIG. 5 is an exemplary embodiment of a method of executing a shader program including color space conversion in accordance with one or more aspects of the present invention. The method is described in the context of Programmable Graphics Processing Pipeline 150 shown in FIG. 2B. Persons skilled in the art will appreciate that the method or another embodiment of the method may be performed using Programmable Graphics Processing Pipeline 150 shown in FIG. 2A or FIG. 2C.

In step 505 Texture Unit 225 receives a fragment and in step 510 Texture Unit 225 determines if the shader program specifies that a texture map will be read to process the fragment. If, in step 510 Texture Unit 225 determines that a texture map will be read to process the fragment, then in step 515 Texture Unit 225 determines if the texture data, e.g., texels, read from the texture map are in a nonlinear color space, such a sRGB format. If, in step 515 Texture Unit 225 determines that the texels are in sRGB format, then in step 520 From sRGB Unit 230 converts the texels from sRGB format to a linear color space, such as RGB format and proceeds to step 525. If, in step 515 Texture Unit 225 determines that the texels are not in sRGB format, then Texture Unit 225 proceeds to step 525. Likewise, if, in step 510 Texture Unit 225 determines that texels will not be read to process the fragment, then Texture Unit 225 proceeds to step 525.

In step 525 Texture Unit 225 outputs the fragment, including the texture data, and Shader Computation Bottom 235 processes the fragment, according to the shader program, to produce a shaded fragment. In step 530 Shader Computation Bottom 235 outputs the shaded fragment to Raster Operation Unit 160 via Shader Register File 245 and Raster Operation Unit 160 performs raster operations using the shaded fragment data to produce processed fragment data. In some embodiments of the present invention, Raster Operation Unit 160 may perform blending operations to produce the processed fragment data, for example by reading fragment data stored in graphics memory via Read Interface 250. In those embodiments of the present invention, Fragment data in nonlinear color space may be optionally converted into linear color space by From sRGB Unit 230 prior to performing the blending operations to combine the fragment data and the shaded fragment data.

In step 535 Raster Operation Unit 160 determines if the processed fragment data should be output, as specified by the shader program, in a nonlinear color space, such as sRGB format, and, if so, the processed fragment data is converted sRGB format by To sRGB Unit 240 and Raster Operation Unit 160 proceeds to step 545. If, in step 535 Raster Operation Unit 160 determines the processed fragment data should not be output in a nonlinear color space, Raster Operation Unit 160 proceeds to step 545. When Programmable Graphics Processing Pipeline 150 shown in FIG. 2A is used, step 530 is performed between steps 535 or 540 and step 545. In the embodiment of the present invention shown in FIG. 2A step 535 is performed by To sRGB Unit 240 within Shader Computation Bottom 235.

In step 545 Raster Operation Processor 260 determines if the processed fragment data will be written to graphics memory. If, in step 545 Raster Operation Processor 260 determines the processed fragment data should be written to graphics memory, then in step 555 Write Interface 255 produces a write request to write the processed fragment data in graphics memory. Otherwise, in step 550 Raster Operation Processor 260 discards the processed fragment data. Persons skilled in the art will appreciate that any system configured to perform the method steps of FIG. 5, or their equivalents, is within the scope of the present invention.

Figure 6A:
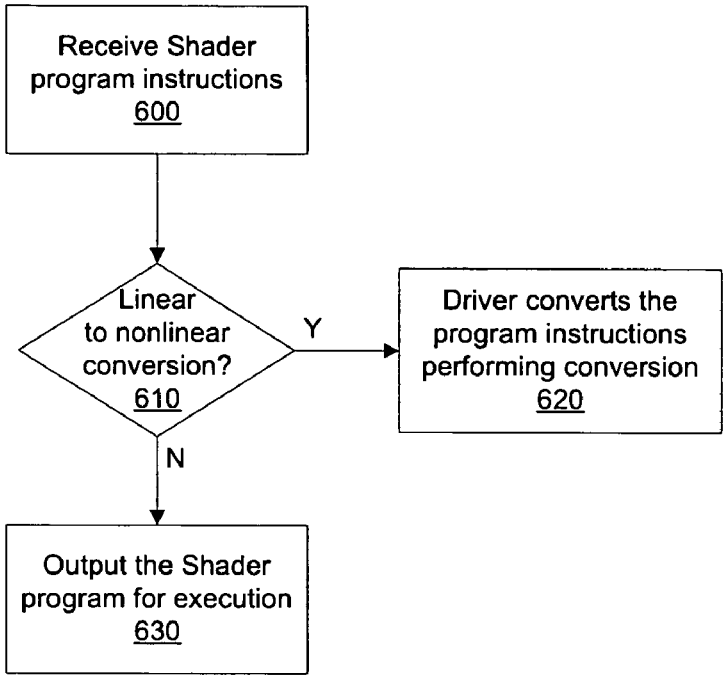
FIGS. 6A and 6B are exemplary embodiments of methods of detecting and converting shader program instructions for color space conversion in accordance with one or more aspects of the present invention.

FIG. 6A is an exemplary embodiment of a method of detecting and converting shader program instructions for color space conversion in accordance with one or more aspects of the present invention. In step 600 a driver receives shader program instructions for a shader program. In step 610 the driver determines if a portion of the shader program instructions configure Programmable Graphics Processing Pipeline 150 to perform color space conversion without using a dedicated conversion unit within Programmable Graphics Processing Pipeline 150. For example, the driver determines if the shader program instructions for performing color space conversion can be converted into a specific shader program instruction for execution by To sRGB Unit 240, and, if so, in step 620 the driver converts the portion of the shader program instructions into the specific shader program instruction for performing linear to nonlinear color space conversion. In some embodiments of the present invention, the specific shader program instruction includes a field for specifying whether each color component will be converted.

If, in step 610 the driver determines the shader program does not include a portion of the shader program instructions that configure the Programmable Graphics Processing Pipeline 150 to perform color space conversion, then in step 630 the driver outputs the shader program for execution by Graphics Processor 105.

Figure 6B:
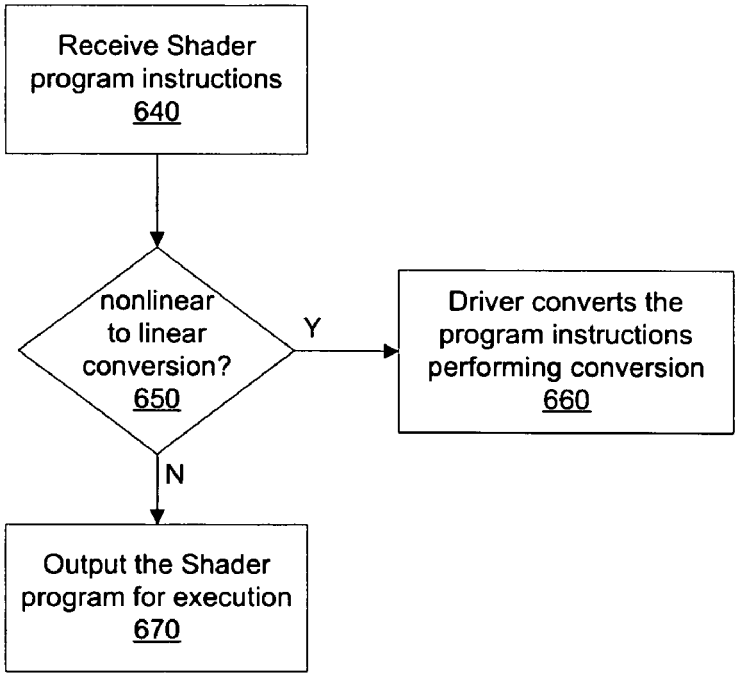

FIG. 6B is an exemplary embodiment of another method of detecting and converting shader program instructions for color space conversion in accordance with one or more aspects of the present invention. In step 640 a driver receives shader program instructions for a shader program. In step 650 the driver determines if a portion of the shader program instructions configure Programmable Graphics Processing Pipeline 150 to perform color space conversion without using a dedicated conversion unit within Programmable Graphics Processing Pipeline 150. For example, the driver determines if the shader program instructions for performing color space conversion can be converted into a specific shader program instruction for execution by From sRGB Unit 230, and, if so, in step 660 the driver converts the portion of the shader program instructions into the specific shader program instruction for performing nonlinear to linear color space conversion. In some embodiments of the present invention, the specific shader program instruction includes a field for specifying whether each color component will be converted.

If, in step 650 the driver determines the shader program does not include a portion of the shader program instructions that configure the Programmable Graphics Processing Pipeline 150 to perform color space conversion, then in step 670 the driver outputs the shader program for execution by Graphics Processor 105. Persons skilled in the art will appreciate that any system configured to perform the method steps of FIGS. 6A, 6B, or their equivalents, is within the scope of the present invention.

Including detection of color conversion in the driver for a graphics processor, such as Graphics Processor 105, permits a shader program written without using a specific color conversion program instruction or without setting a color conversion flag to have improved performance for color conversion operations.

The invention has been described above with reference to specific embodiments. It will, however, be evident that various modifications and changes may be made thereto without departing from the broader spirit and scope of the invention as set forth in the appended claims. The foregoing description and drawings are, accordingly, to be regarded in an illustrative rather than a restrictive sense. The listing of steps in method claims do not imply performing the steps in any particular order, unless explicitly stated in the claim.

All trademarks are the respective property of their owners.

The invention claimed is:

1. A method implemented by a shader program in a graphics processing environment for converting a plurality of RGB color components from a linear RGB color space to a nonlinear sRGB color space the method comprising:

receiving, at the shader program, a plurality of RGB color components in the linear color RGB space;

selecting one or more of the RGB color components for individual conversion to non-linear sRGB data, wherein each of the RGB color components includes a sign, an exponent, and a mantissa;

for each RGB color component selected, executing the steps of:

processing the selected RGB color component to produce an sRGB color component represented in the nonlinear sRGB color space, by:

generating an index to a look-up table based on a portion of the exponent of the selected RGB color component, based on the index, extracting from the look-up table a first color component represented in the non-linear sRGB color space, and clamping the first color component based on the sign and the portion of the exponent of the selected RGB color component to produce a second color component represented in the non-linear sRGB color space, and storing the second color component in a frame buffer memory.

2. The method of claim 1, wherein the selected RGB color component is represented as a floating point value.

3. The method of claim 2, wherein the selected RGB color component is a 16-bit floating point value.

4. The method of claim 2, wherein the selected RGB color component is a 32-bit floating point value.

5. The method of claim 1, wherein the selected RGB color component is one of red, green, and blue.

6. The method of claim 1, further comprising determining if the exponent of the selected RGB color component is overflowed, and, if so, then selecting a value of one for the second color component in the non-linear sRGB color space.

7. The method of claim 1, further comprising determining if the sign of the selected RGB color component is negative, and, if so, then selecting a value of zero for the second color component in the non-linear sRGB color space.

8. The method of claim 1, further comprising processing only the selected RGB color component to produce the second color component in the non-linear sRGB color space.

9. The method of claim 1, further comprising executing the shader program, including:

receiving shader program instructions;

determining that a portion of the shader program instructions is intended to perform color space conversion;

inserting a specific color conversion shader program instruction into the shader program; and executing the specific color conversion shader program instruction to produce converted sRGB data only for the selected RGB color component.

10. The method of claim 9, wherein the specific color conversion shader program instruction specifies the RGB color component being converted.

* * * * *

UNITED STATES PATENT AND TRADEMARK OFFICE

CERTIFICATE OF CORRECTION

PATENT NO. : 7,593,021 B1
APPLICATION NO. : 10/939624
DATED : September 22, 2009
INVENTOR(S) : Tynefield, Jr. et al.

It is certified that error appears in the above-identified patent and that said Letters Patent is hereby corrected as shown below:

In column 11, line 57, please replace "space the" with -- space, the --.

Signed and Sealed this

Sixteenth Day of March, 2010

David J. Kappos

David J. Kappos
*Director of the United States Patent and Trademark Office*